United States Patent [19]

Blossom

[11] Patent Number: 4,591,054

[45] Date of Patent: May 27, 1986

[54] COMBINATION PURSE-COUPON ORGANIZER DEVICE, METHODS OF CONSTRUCTING AND UTILIZING SAME

[76] Inventor: Carolyn S. Blossom, 202 S. Main, Concord, Mich. 49237

[21] Appl. No.: 633,285

[22] Filed: Jul. 23, 1984

[51] Int. Cl.[4] ..... B65D 85/00

[52] U.S. Cl. ..... 206/425; 206/459; 206/831

[58] Field of Search ..... 206/425, 459, 831

[56] References Cited

U.S. PATENT DOCUMENTS

| | | | |
|---|---|---|---|
| 4,260,055 | 4/1981 | Slaybaugh | 206/425 |
| 4,312,393 | 1/1982 | Green | 206/425 |
| 4,442,980 | 4/1984 | McIntosh | 206/425 |
| 4,463,848 | 8/1984 | Parker | 206/425 |

*Primary Examiner*—Joseph Man-Fu Moy

*Attorney, Agent, or Firm*—Irving M. Weiner; Joseph P. Carrier; John J. Cantarella

[57] ABSTRACT

Two master sets of seven seventh cut cards having labels denoting major grocery categories thereon. Fourteen subsets of physically smaller cards. Each subset has seven seventh cut cards with labels denoting grocery subcategories and each subset being related to one major card. In a given set each master card may be a different color. The subset cards are preferably the same color as the associated master card.

One set of master cards and associated subset cards may be placed in one pocket of a purse and the other cards in another other pocket of the same purse.

7 Claims, 3 Drawing Figures

COMBINATION PURSE-COUPON ORGANIZER DEVICE, METHODS OF CONSTRUCTING AND UTILIZING SAME

BACKGROUND OF THE INVENTION

1. Field of the Invention

This invention relates to combination purse-organizer devices. More particularly, the invention is a purse having labelled cards therein for organizing coupons.

The term "cut", when immediately preceded by a number, and used to describe a card or set of cards, indicates that each card in the set has a superior projection or tab; and that each tab in the set is at least slightly offset from the other tabs in the set. Some overlap of the tabs is allowable. The number preceding the term "cut" specifies the number of tabs per set. Thus, the term "seventh cut" signifies that there are seven cards in the set, and that each card has a tab that can be viewed without riffling through the cards of the set.

2. Description of Relevant Art

People love to organize everything that affects their lives. Some of the devices for organizing paper products are described as follows:

U.S. Pat. No. 2,763,311, entitled "Multi-Card Holder" discloses a holder for displaying a multiplicity of cards, photographs, etc. The holder includes a backing member having transparent plastic card retainers secured thereto and adapted to be folded in the manner of a book for compact storage, and unfolded to permit viewing of the cards or photos.

U.S. Pat. No. 4,004,690 discloses a device for holding coupons in an organized relation. The device comprises panel support members of leather or similar material which are hingedly secured together so as to be folded over on each other. Transparent coupon pockets are hingedly secured to the panels, and have labels attached to upper stepped edges thereof to classify coupons inserted in the pockets.

U.S. Pat. No. Des. 265,021 discloses a checkbook cover device having a folded-over configuration and provided with a closure flap which is secured with a VELCRO brand fastener.

An extract from the "Carol Wright Gifts" catalog dated © 1979 and entitled "The Family Financial Organizer" discloses a device for organizing financial records on a month to month basis. An individual, labelled pocket is provided for each month's records. Additional pockets are provided for other types of financial records. The pockets are arranged in a folding leather-like case.

The invention disclosed herein has features which none of the above described devices have. These features include cards in two different size categories. The larger cards organize items by major food category. The smaller cards organize items within a major category by sub-category.

Additionally, the invention disclosed herein utilizes a clutch type purse having multiple pockets for storing these cards and the coupons. The multiple pockets also serve as organizers by allowing the cards to be separated according to logical divisions satisfactory to the user.

SUMMARY OF THE INVENTION

The present invention provides a device for organizing coupons. This device includes a collection of large index cards and a second collection of index cards of a smaller size.

The large cards are divided into two master sets. Preferably, there are seven cards to a master set. A subset of smaller cards is provided for each card in the master set. Preferably, there will be seven cards in each subset. Labels are provided for each of the cards. Each card in the master group is provided with a label indicating a major grocery category such as beverages, condiments and spreads, recipe ingredients, grain products, vegetables and fruit, one step meals, complete protein, household items, kitchen aids, laundry, hygiene, health aids, snacks, desserts, or dry meal products.

The cards in any given subset are related to a single master card. The labels on each card in any given subset are thus related to the label on the master card in a subcategory to category relation. For purposes of example, subset labels for the subset related to the master card labelled "Beverages" could be creamer, milk flavorings, packaged, canned, bottles, or frozen.

In addition to the labels, it is preferred, although it is not necessary, that each master card in the first master card set be of a different color than the other master cards in that set.

It is also preferred, although it is not necessary, that each master card in the second master set be of a different color than the other master cards in that set.

Although it is not necessary, it is preferred that each subset card should have the same color as the master card it is associated with.

The invention also includes a purse. The purse has at least two pockets. The cards are placed into these pockets for storing and organizing the cards and the coupons.

The first master card set can be placed in one pocket, and the second master card set can be placed in the other pocket.

DETAILED DESCRIPTION OF THE PREFERRED EMBODIMENTS

Figure 1:
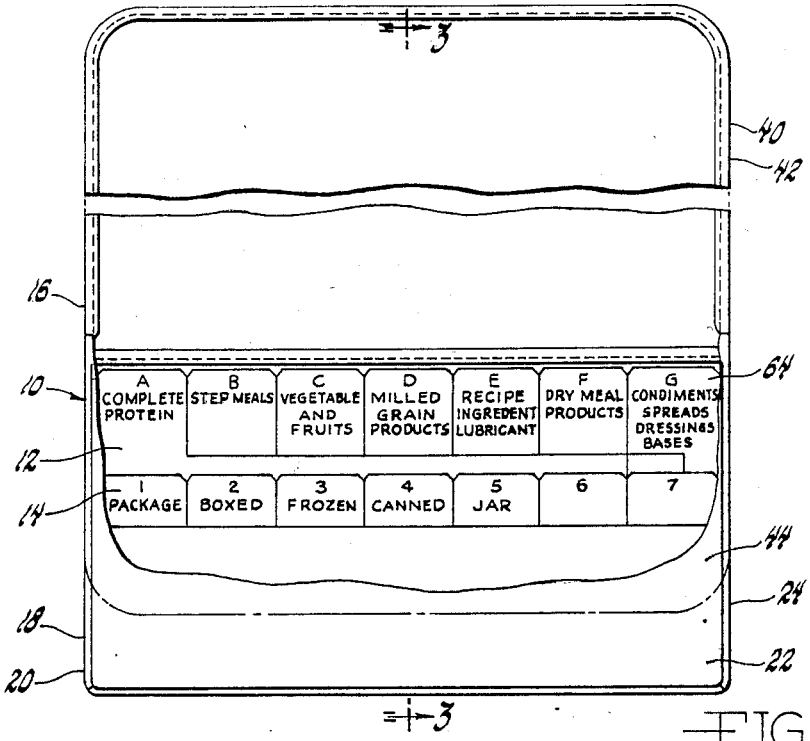
FIG. 1 is a sectional view of an embodiment of the purse-coupon organizer.

With reference to FIG. 1, there is shown a purse-coupon organizer 10. Coupon-organizer 10 includes a first master set of cards 12, a first subset of cards 14, and a purse 16.

Figure 3:
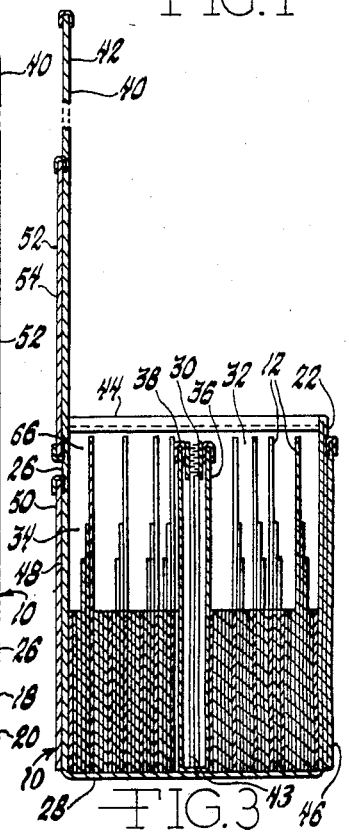
FIG. 3 is a sectional view of the embodiment of the invention depicted in FIG. 1 taken along lines 3—3.

Purse 16 includes a rectangular main body part 18. As depicted in FIGS. 1 and 3, main body part 18 has a box-like structure. It includes a first side wall 20 communicating at one end with front wall 22, which in turn communicates at an opposing end with second side wall 24, which in turn communicates at an opposing end with rear wall 26. Each of these walls communicates with a corresponding edge of base 28.

In FIG. 3, partition 30 is parallel to and intermediate front wall 22 and rear wall 24.

First interior pocket 32 is defined by first side wall 20, front wall 22, partition 30, second side wall 24, and base 28.

Second interior pocket 34 is defined by first side wall 20, partition 30, second side wall 24, and rear wall 26.

Partition 30 may consist of two parallel walls: front partition wall 36 and rear partition wall 38.

Center interior pocket 43 is defined by first side wall 20, front partition wall 36, second side wall 24, and rear partition wall 38.

Main flap 40 serves as a cover for the interior pockets. It hingedly communicates, at one end, with an upper portion of rear wall 26 and rotates from an open position 42 to a closed position 44 or any intermediate position. In the closed position 44, flap 40 overlies the interior pockets and a portion of flap 40 contacts front wall 22. In the open position 42 said interior pockets are open and accessible by the person using the coupon-organizers.

Front panel 46 is attached, at it lower edge and along its sides, to front wall 22 to form a front exterior pocket.

Figure 2:
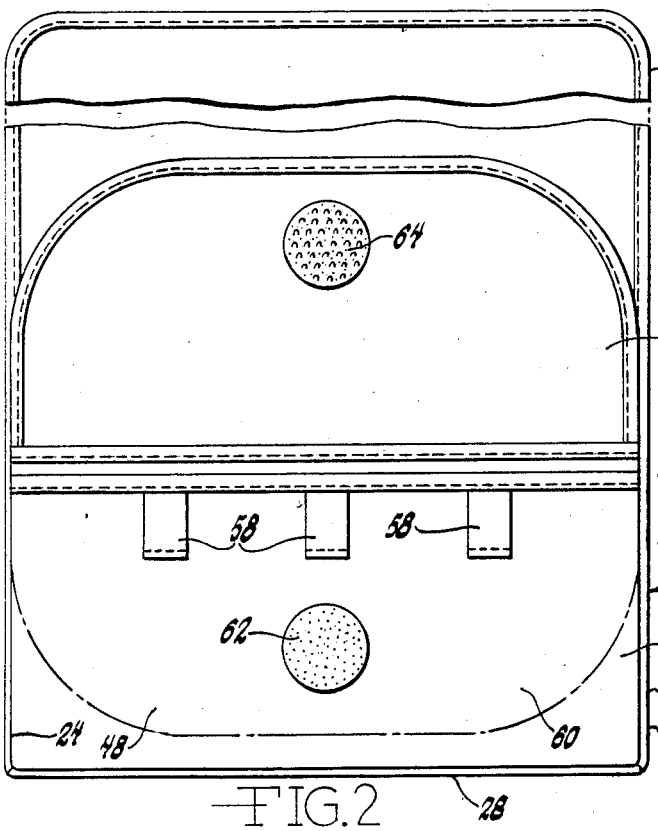
FIG. 2 is a rear view of the purse-coupon organizer depicted in FIG. 1.

With reference to FIG. 2 and FIG. 3, rear panel 48 is attached, at its lower edge and along its sides, to rear wall 26 to form a rear exterior pocket 50.

Rear flap 52 hingedly communicates at one end with rear wall 26. Flap 52 serves as a closure for rear exterior pocket 50 and rotates from a pocket open position 54 to a pocket closed position 56.

Pencil holder 58 is formed from three parallel, vertical strips of material attached to the exterior of rear exterior panel 60.

First Velcro brand patch 62 is attached to the exterior of rear panel 48 and second Velcro brand patch 64 is matably attached to rear flap 52.

First master card set 12 is seventh cut. That is each card in the set has a tab 64 on an upper end which is visible without riffling through the set.

As depicted in FIG. 1, each card in the first master set 12 has a label thereon. Exemplary labels are Complete Protein; One Step Meals; Vegetables and Fruits; Grain Products; Recipe Ingredients, Condiments, Spreads. Other exemplary labels which may be used include Beverages; Household Items; Kitchen Aids; Laundry; Hygiene; Health Aids; Snacks; Desserts.

As depicted in FIG. 3, a second master card set 66 may be included in the coupon-purse organizer. The other exemplary labels indicated above would normally appear on the individual card tabs of this second master set 66.

Each master set of cards preferably has a subset of physically smaller cards associated with it. Preferably, each master set of cards will be seventh cut, and each master card will have seven subset cards associated with it. As depicted in FIG. 1, the first subset of cards includes the labels Package; Boxed; Frozen; Canned; Jar; a tab labelled 6 and a tab labelled 7. More descriptive labels for tabs 6 and 7 can be added by the user.

Preferably the labels of cards in each subset will relate in a meaningful fashion to the master card that particular subset is associated with. Exemplary subset labels for each of the following master card labels are as follows:

Beverages: Creamer, Coffee, Tea; Milk, Flavorings; Packaged; Canned; Bottles; Frozen.

Condiments and Spreads: Sweets; Nut Spread; Mustard, Ketchup; Mayo Types; Dressings; Dips.

Recipe Ingredients: Spices, Flavorings; Sweeteners; Oleo Oil, Shortening; Nuts & Chips; Packaged Mixes; Canned.

Grain Products: Pastas; Rice; Flours; Corn Meals; Breads; Rolls; Cereals.

Vegetables and Fruit: Fresh; Frozen; Canned; Jars; Packaged; Baby.

One Step Meals: Frozen; Packaged; Canned; Boxed; Boxed Breakfast; Baby.

Complete Protein: Fresh; Frozen; Packaged; Canned; Cheese; Baby.

Household Items: Polishes; Carpet Products; Deodorizers; Cleaners; One Step Cleaners; Bowl Cleaners.

Kitchen Aids: Dish Cleaners; Scouring Cleansers; Paper; Plastic; Polishes.

Laundry: Detergent; Softeners; Spot Cleaners; Disinfectant; Degreaser, Baby.

Hygiene: Soaps and Scents; Hair; Deodorant; Face Care; Cosmetics; Baby.

Health Aids: Pain Relievers; Cold Preps; Nasal Preps; Mouth, Teeth; Body Preparations; Baby.

Snacks: Potato; Corn; Cheese; Crackers; Sweets.

Desserts: Fresh; Frozen Canned; Packaged; Mixes; Baby.

To further aid the user in locating the appropriate coupon, the cards may be color coded. Preferably, each master card in the first master set will be a different color and each master card in the second set will be a different color. The same color may be used in both master sets.

The following are proposed colors that can be used for a given master card:

Beverages: Yellow
Condiments and Spreads: Brown
Recipe Ingredients: Orange
Grain Products: Purple
Vegetables and Fruit: Green
One Step Meals: Blue
Complete Protein: Red
Household Items: Yellow
Kitchen Aids: Brown
Laundry: Orange
Hygiene: Purple
Health Aids: Green
Snacks: Blue
Desserts: Red Preferably, each subset card will be the same color as the master card it is associated with.

As depicted in FIG. 3, first master set 12 can be placed in first interior pocket 32, and second master set 66 can be placed in second interior pocket 34. Each master card has a subset of cards associated with it. Generally, a subset will lie immediately in front of the master card it is associated with.

In operation, the user will first locate the major grocery category a coupon relates to by scanning the master card labels. The user will then locate the appropriate subcategory within that category by scanning the associated subset card labels. The coupon will be located adjacent the appropriate subset card. Thus, the user can determine where the coupon is to be either stored at or retrieved from.

Although there have been described what are here considered to be the preferred embodiments of the invention, it will be understood that the invention may be embodied in other specific forms without departing from the spirit or central characteristics thereof. The present embodiments are, therefore, to be considered in all respects as illustrative, and not restrictive.

I claim:

1. A combination purse/coupon organizer, comprising in combination:

a purse including a main body part, said main body part defining a first interior pocket;

a partition within the purse spaced relative to the main body of the purse to define a second interior pocket of approximately the same dimensions as said first pocket;

a flap, overlying said pockets, having a first end hinged to the exterior of said main body part, and having a second end securable to the main body part of the purse at a location removed from and opposed to the point of attachment of the first flap end;

a means for arranging coupons positioned within said pocket purse;

said arranging means including a first master set of seventh cut index cards;

a subset of index cards associated with each card in said master set;

each card in said subset being smaller than the card in the master set with which it is associated;

a different label on each master card for relating each master card to a category of coupons which are to be associated with it;

a different label on each subset card relating each card in a subset to a sub-category of coupons which are to be associated with that card; and wherein each card in the master set is a different color, and the cards in each subset are the same color as the master card with which they are associated.

2. The coupon organizer of claim 1, wherein:

said arranging means includes a second master set of seven seventh cut index cards.

3. The coupon organizer of claim 2, wherein:

each subset of cards is seventh cut.

4. The coupon organizer of claim 3, wherein:

each label in the following list appears on an index tab of one of the cards in a master set: A:COMPLETE PROTEIN; B:ONE STEP MEALS; C:VEGETABLE AND FRUITS; D:GRAIN PRODUCTS; E:RECIPE INGREDIENTS; F:CONDIMENTS, SPREADS; G: BEVERAGES.

5. The coupon organizer of claim 4, wherein:

said partition includes a first wall and a second wall;

said first and second walls are abutted by the main body part to define a third pocket.

6. The coupon organizer of claim 5, further comprising:

a first sheet of material having a lower edge and two sides attached to the exterior of the main body part, said first sheet of material and said main body part forming a first exterior pocket; and a second sheet of material having a lower edge and two sides attached to the exterior of the main body part at a location directly opposite said first exterior pocket;

said second sheet of material and said main body part defining a second exterior pocket.

7. A method of constructing a coupon organizer, comprising the steps of:

forming a first and a second master set of cards, each master set of cards having seven cards, and each master set being seventh cut;

placing major grocery category labels on each card in the two master sets of cards;

forming a subset of cards for each master set of cards, each subset having seven cards, and each subset being seventh cut;

placing subcategory labels on each subset card;

placing a subset of cards adjacent the master card it is related to as a subcategory label to category label, alternating master card and subset;

placing the first master set and related subsets into one pocket of a purse;

placing the second master set and related subsets into another pocket of the same purse;

forming each card in said first and second master sets of cards in a different color; and forming the cards in each subset in the same color as the master card with which they are associated.

* * * * *